United States Patent [19]

Mastrodicasa

[11] Patent Number: 4,669,692

[45] **Date of Patent: * Jun. 2, 1987**

[54] ADJUSTABLE BRACKET ASSEMBLY FOR SUPPORTING A SHELF

[76] Inventor: Arthur R. Mastrodicasa, 5 Elmcrest Cir., Walpole, Mass. 02081

[ * ] Notice: The portion of the term of this patent subsequent to Apr. 21, 2004 has been disclaimed.

[21] Appl. No.: 667,448

[22] Filed: Nov. 1, 1984

Related U.S. Application Data

[63] Continuation-in-part of Ser. No. 593,665, Mar. 26, 1984, abandoned.

[51] Int. Cl.[4] ..... A47F 5/08

[52] U.S. Cl. ..... 248/250; 248/241; 248/235; 211/134; 211/187

[58] Field of Search ..... 248/250, 241, 187, 235, 248/310, 243, 298, 299, 122, 423; 108/108; 211/134, 186, 187, 153; 292/264; 403/108, 328

[56] References Cited

U.S. PATENT DOCUMENTS

| | | | |
|---|---|---|---|
| 470,777 | 3/1892 | Billings | 403/108 X |
| 826,321 | 7/1906 | Eustis | 248/250 |
| 1,035,967 | 8/1912 | Keil | 248/250 |
| 1,176,588 | 3/1916 | Miller et al. | 248/250 |
| 1,230,999 | 6/1917 | Christ | 248/250 X |
| 1,702,937 | 2/1929 | Friedemann | 248/243 |
| 1,779,236 | 10/1930 | Hoegger | 248/250 |
| 2,136,109 | 11/1938 | Kress | 248/243 X |
| 2,673,109 | 3/1954 | Frost | 292/150 X |
| 3,321,089 | 5/1967 | Krikorian | 211/134 |
| 3,353,684 | 11/1967 | Chesley | 211/187 |
| 3,355,134 | 11/1967 | Chesley | 248/250 |
| 3,565,381 | 2/1971 | Oliver | 248/243 |
| 4,518,002 | 5/1985 | Battison, Sr. et al. | 403/328 X |

FOREIGN PATENT DOCUMENTS

| | | | |
|---|---|---|---|
| 601755 | 7/1960 | Canada | 108/108 |
| 1299250 | 6/1962 | France . | |
| 414757 | 8/1934 | United Kingdom | 248/241 |

*Primary Examiner*—Ramon S. Britts
*Assistant Examiner*—Karen J. Chotkowski
*Attorney, Agent, or Firm*—Scott R. Foster

[57] ABSTRACT

An adjustable bracket assembly for supporting a shelf, the assembly including a bracket member having a notch therein for receiving a shelf first portion, a slide member moveably mounted on the bracket member and having a notch therein for receiving a shelf second portion, and a lock means for locking together the bracket and slide members.

1 Claim, 5 Drawing Figures

ADJUSTABLE BRACKET ASSEMBLY FOR SUPPORTING A SHELF

CROSS-REFERENCE TO RELATED APPLICATION

This is a continuation-in-part of application Ser. No. 593,665, filed Mar. 26, 1984, now abandoned in the name of Arthur R. Mastrodicasa.

BACKGROUND OF THE INVENTION

1. Field of the Invention

This invention relates to shelf-supporting devices and is directed more particularly to an adjustable bracket assembly adapted to securely support shelving of various sizes and configurations.

2. Description of the Prior Art

Shelf-supporting brackets of the type finding utility in retail outlets are generally well known and various embodiments are adapted to operate under given conditions.

U.S. Pat. No. 3,321,089, issued May 23, 1967 to G. Krikorian is illustrative of a shelf-supporting bracket comprising an arm having notches therein suited for receiving flexible wires of a wire shelf. Other examples of brackets adapted for use with wire shelving include U.S. Pat. No. 3,355,134, issued Nov. 28, 1967 to R. G. Chesley, and U.S. Pat. No. 3,565,381, issued Feb. 23, 1971 to Earl J. Oliver, both of which show the use of fasteners, or clamps, on bracket members to secure wire portions of shelving thereto. The fasteners may be moved about upon the brackets to provide for adjustability and thereby attain a degree of usefulness not found in the Krikorian device.

Other embodiments of adjustable shelf supports are found in U.S. Pat. No. 1,702,937, issued Feb. 19, 1929 to M. M. Friedemann, and U.S. Pat. No. 1,779,236, issued Oct. 21, 1930 to J. A. Hoegger. In Friedemann, a slide member is mounted on a bracket arm and used in conjunction with an "angle member" to squeeze opposite edges of a shelf therebetween. The bracket arm and angle member are both mounted upon a vertical standard. In Hoegger, a shelf supporting arm has a notch on its upper edge, and a spring-biased extension protruding from the free end thereof, the extension having a notch opposed to the arm notch, such that a shelf may be gripped at opposite edges by the two notches, under a spring bias. Neither Friedemann nor Hoegger is directed specifically to wire shelving.

In U.S. Pat. application Ser. No. 593,665, filed Mar. 26, 1984, in the name of Arthur R. Mastrodicasa, there is disclosed an adjustable bracket assemply for use with wire shelving in which the wire members are substantially rigid. The assembly includes an arm, a slide member slidably mounted on the arm, and a lock means for locking the arm and slide member in a selected position suitable for a selected shelf. The assembly is capable of use independently of additional fastening structures, such as angle members, clamps, and the like.

SUMMARY OF THE INVENTION

An object of the present invention is to provide an adjustable bracket assembly of the type disclosed in the aforesaid '665 application but providing an alternative structure having a greater range of adjustability.

Another object of the invention is to provide such an assembly which, though adjustable, is completely secure in its shelf-retaining function.

A further object of the invention is to provide such an assembly which, though strong and durable, is readily manufactured inexpensively and which, in the market place, is easy and safe to use.

With the above and other objects in view, as will hereinafter appear, a feature of the present invention is the provision of a bracket assembly for supporting a shelf, the assembly comprising a bracket member, the bracket member having a first notch end therein, the first notch end being adapted to receive a shelf first portion therein, a slide member mounted on the bracket member, the slide member having a second notch end therein, the second notch end being adapted to receive a shelf second portion therein, the slide member being slidably moveable upon the bracket member to selectively determine spacing between the first and second notch ends, and a lock means interconnecting the bracket member and the slide member for securing the slide member in a selected fixed position on the bracket member, such that the first and second notch ends exert a fixed holding pressure on the shelf first and second portions.

The above and other features of the invention, including various novel details of construction and combinations of parts, will now be more particularly described with reference to the accompanying drawings and pointed out in the claim. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
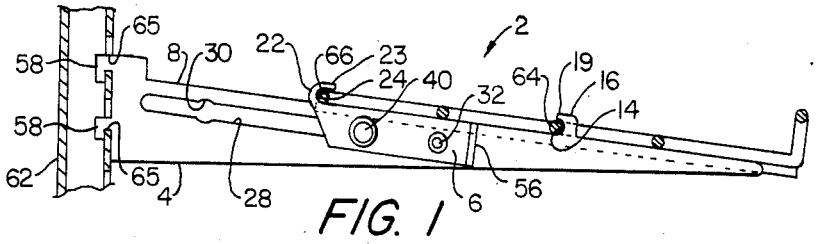
FIG. 1 is a right side elevational view of one form of bracket assembly illustrative of an embodiment of the invention, shown in combination with an upright support and wire shelf, the latter elements shown in section for clarity.

Referring to the drawings, it will be seen that the illustrative bracket assembly 2 includes a bracket member 4 and a slide member 6 mounted on the bracket member.

Figure 3:
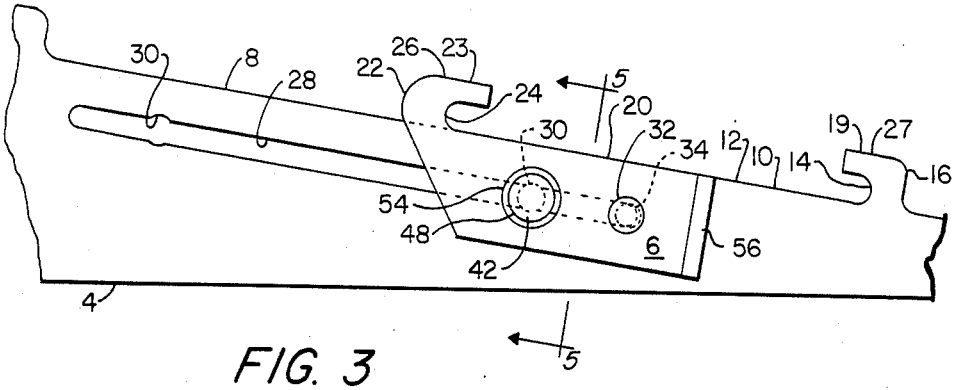
FIG. 3 is an enlarged right side elevational view of the bracket assembly.

The bracket member 4 comprises a rigid, elongated, substantially planar member, preferably of metal. A first lengthwise edge 8 of the bracket member, the upper edge as viewed in FIGS. 1 and 3, is provided with an elongated notch 10 having a lengthwise edge 12 coincident with the bracket member edge 8. A first end 14 of the notch 10 is formed by a first hook portion 16 extending outwardly from the bracket edge 8 and having a leg portion 19 adapted to overlie a shelf first portion.

The slide member 6 (FIG. 3) comprises a rigid, elongated member, preferably of metal, having a planar portion 17 (FIG. 4) disposed adjacent a planar surface 18 of the bracket member 4 and slidable thereon. The slide member 6 is provided with an edge 20 disposed coincidentally with the bracket member notch lengthwise edge 12 (FIGS. 1 and 3). A second hook portion 22 extending outwardly from the slide member edge 20 forms a notch end 24. The second hook portion 22 is also provided with a leg portion 23 adapted to overlie a shelf second portion. An upper edge 26 of the second hook portion 22 is substantially aligned with an upper edge 27 of the first hook portion 16. The first and second notch ends 14, 24 are thus in alignment with each other and opposed.

Figure 4:
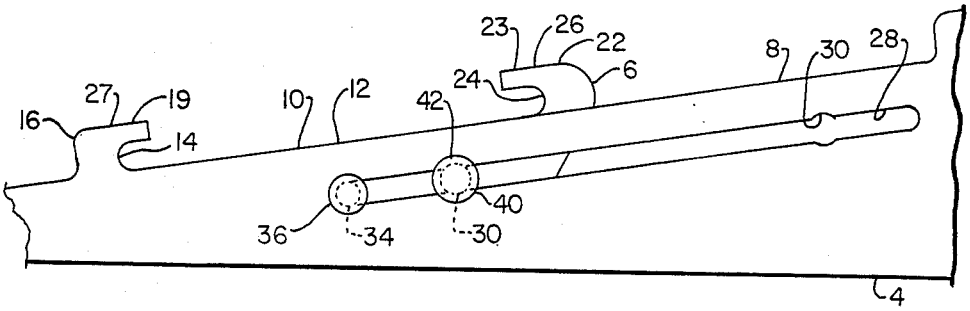
FIG. 4 is an enlarged left side elevational view of the bracket assembly.

The bracket member 4 is provided with opening means, preferably in the form of an elongated slot 28, having enlarged portions 30 disposed along the length thereof. Two such portions are shown in FIGS. 3 and 4, but any desired number of such enlarged portions may be incorporated in the slot 28. A first pin 32 (FIG. 3) is fixed to the slide member 6, a shank portion 34 of the pin 32 extending through the slot 28. The first pin 32 is provided with a head 36 (FIG. 4) larger than the width of the slot 28, to retain in a slidable mode the slide member 6 upon the bracket member surface 18.

A second pin 40 is mounted for reciprocal movement in the assembly and includes a first enlarged head 42, a first enlarged shank portion 44, a second shank portion 46 and a second enlarged head 48. The second pin second shank portion 46 is disposed in a hole 50 in the slide member 6. The second pin first enlarged shank portion 44 is larger in diameter than the width of the slot 28, but slightly smaller than the enlarged portions 30 of the slot 28. The second shank portion 46 of the pin 40 extends through the hole 50 and is joined to the second enlarged head 48. A coil spring 54 is disposed between the head 48 and the slide member 6 and biases an edge 52 of the shank portion 44 firmly against the bracket member 4 to hold the members 4, 6 together (not shown).

Figure 5:
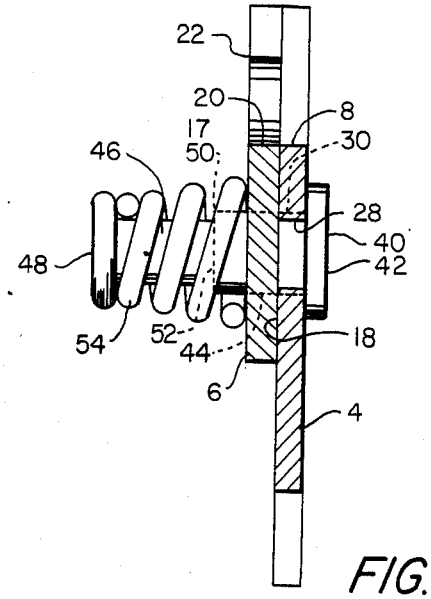
FIG. 5 is a sectional view of the bracket assembly taken along line 5—5 of FIG. 3.

If the slide member 6 is moved to the right, as viewed in FIGS. 1 and 3, to a point at which the second pin first enlarged shank portion 44 is in alignment with one of the slot enlarged portions 30, the shank portion 44 will be caused by the coil spring 54 to snap into the enlarged slot portion, to securely lock the bracket member 4 and the slide member 6 together (FIG. 5).

The slide member 6 preferably is provided with a grip portion 56 extending outwardly from the bracket member at an angle to the plane of the slide member planar portion 17.

The bracket member 4 is preferably provided with tab portions 58 integral with an end of the bracket member for engaging holes 65 in a support member 62 and thereby connecting the bracket member to the support member (FIG. 1).

Figure 2:
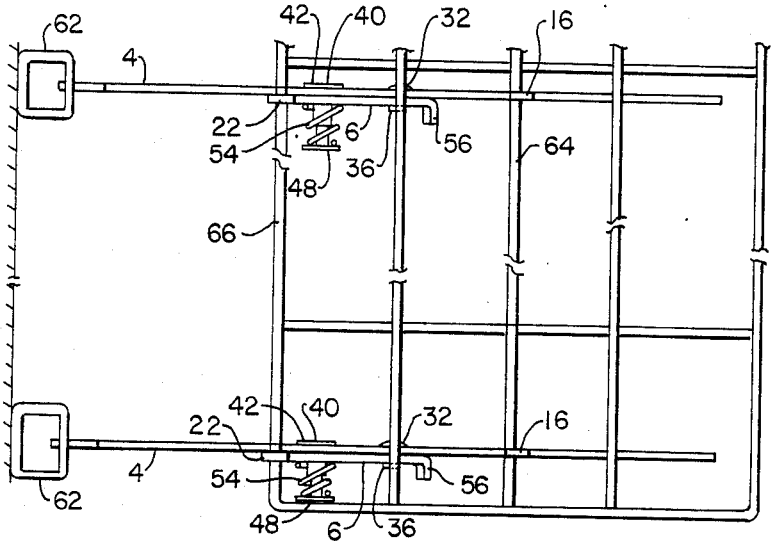
FIG. 2 is a top plan view of the elements shown in FIG. 1.

The illustrative invention, as above described, is ideally suited for use in combination with shelves of the rigid wire type, with which the assembly is illustrated in FIGS. 1 and 2. As may be seen, the first notch end 14 is adapted to receive a shelf first portion, such as a wire 64, and the second notch end 24 is adapted to receive a shelf second portion, such as a wire 66. Upon manual depression of the head 48, the slide member 6 is slidably moveable on the bracket member 4 to selectively determine the spacing between the first and second notch ends 14, 24. Upon releasing the head 48, the slide member is held against the bracket member by the force of the spring 54, in a selected position, such that the first and second notch ends retain the shelf first and second portions, or wires 64, 66.

The pressure of the spring 54 is sufficient to permit usage of the assembly for a variety of wire spacings. However, it is intended that the assembly be provided for use with shelving having known wire spacing. It is preferable that the spacing of two wires of the shelving coincide with the spacing of the first and second notch ends 16, 24 when the slide member 6 is positioned on the bracket member such that the second pin enlarged shank portion 44 is disposed in one of the slot enlarged portions 30, thereby positively locking the members 4, 6 together with the wires 64, 66 captured in the notch ends 14, 24.

It will be apparent that in the locked position, the shelf first wire 64, disposed in the first notch end 14 is blocked by the first hook portion 16, including the leg portion 19, from moving in any but a first direction, toward the support member 62, and that the shelf second wire 66, disposed in the second notch end 24, is blocked by the second hook portion 22, including the leg portion 23, from movement in any but a second direction, away from the support member 62. Thus, inadvertent dislodging of the shelf from the assembly is positively prevented.

If it is desired to change to a shelf having a different wire spacing, an operator need only depress the locking pin head 48, against the bias of the spring 54, slide the slide member 6 to a releasing position and remove the shelf. Wire portions of a new shelf can then be inserted between the notch ends 14, 24, the slide member 4 moved to a position in which holding pressure is exerted on the wires disposed in the first and second recesses, and locked in place by releasing the locking pin head 48; or, preferably, the slide member 4 moved to a position in which the second pin shank 44 enters a slot enlarged portion 30, and locked in place by increasing the locking pin head 48.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patents of the United States is:

1. A bracket assembly supporting a shelf, said assembly comprising a pair of main bracket members, each of said main bracket members comprising a pair of rigid elongated, substantially flat planar members, said flat planar members each having a first hook upstanding proximate one of its ends, said first hook receiving a shelf first portion therein, a slide member mounted on each said bracket member, each said slide member comprising a rigid, elongated flat member having a planar portion disposed adjacent and bearing against a flat surface of each said main bracket member, each said slide member having a second hook upstanding therefrom generally opposed to each said first hook, each said second hook receiving a shelf second portion therein, each said slide member being slidably moveably flat against each said main bracket member to selectively determine spacing between said first and second hooks, each said main bracket member having an elongated slot therein, each said slot having an enlarged portion therein, a first pin fixed at one end to each said slide member, a shank portion of said first pin extending through said slot in each said bracket member, a head at the free end of each said shank portion, each said head having a diameter larger than the width of said slot and the width of said slot enlarged portion retaining each said slide member slidably on each said flat main bracket member, and a second pin mounted in each assembly, each said second pin comprising a first enlarged flat head disposed on a side of said bracket member removed from said slide member, an enlarged shank portion extending normally from each said first enlarged flat head, each said enlarged shank portion having a diameter sightly smaller than the width of said slot enlarged portion and greater than the width of said elongated slot and extending transversely normal and through each said main bracket and slide, a smaller shank portion extending from each said enlaged shank portion and of lesser diameter than said enlarged shank portion and of a diameter slightly less than the width of said elongated slot in each said main bracket member, each said smaller shank portion extending at a right angle through said slot, and a second enlarged head fixed to the end of said second pin remote from said first enlarged head, a spring mounted on said smaller shank portion between said second enlarged head and said flat slide member, whereby said enlarged shank portion enters sais slot enlarged portion and is urged by said spring to remain in said slot enlarged portion to lock said flat slide member in a flat fixed position contiguous on said main flat bracket members, and said enlarged shank portions having thereon shoulders which are urged by said springs into forceful engagement with the margins of said slots to secure each said flat slide member on each said flat main bracket member in contiguous flat sliding contact at locations in which said second pin enlarged shank portion is disposed along each said slot not in aligment with each said slot enlarged portion, said second pin thereby comprising a lock menas interconnecting each said flat bracket member and each said flat slide member for securing each said flat slide member in a selected fixed position on each said flat planar member so that each said first and second hooks on each said flat bracket and each flat slide member retains said shelf in selective position.

* * * * *